US005659937A

United States Patent [19]

Santi

[11] Patent Number: 5,659,937

[45] Date of Patent: Aug. 26, 1997

[54] ROLLING TOOL FOR FORMING A VALVE SEAT RETAINER

[75] Inventor: John D. Santi, West Allis, Wis.

[73] Assignee: Briggs & Stratton Corporation, Wauwatosa, Wis.

[21] Appl. No.: 547,950

[22] Filed: Oct. 25, 1995

Related U.S. Application Data

[62] Division of Ser. No. 443,378, May 17, 1995, Pat. No. 5,522,353.

[51] Int. Cl.[6] ..... B23P 11/00

[52] U.S. Cl. ..... 29/243.517; 72/71; 29/888.44; 29/283.5

[58] Field of Search ..... 29/243.517, 888.44, 29/441, 511, 283.5; 72/71, 126

[56] References Cited

U.S. PATENT DOCUMENTS

| | | | |
|---|---|---|---|
| 582,064 | 5/1897 | Hutchison | 72/71 |
| 1,573,448 | 2/1926 | Purnell | 72/71 |
| 1,783,884 | 12/1930 | Lee . | |
| 1,795,433 | 3/1931 | Leipert . | |
| 1,949,613 | 3/1934 | McDonald . | |
| 1,949,614 | 3/1934 | McDonald . | |
| 2,008,002 | 7/1935 | Calkins | 29/243.517 |
| 2,139,682 | 12/1938 | Hothersall | 72/71 |
| 2,165,311 | 7/1939 | Stancliff . | |
| 3,285,235 | 11/1966 | Euberschaer . | |
| 3,395,441 | 8/1968 | Herbenar | 29/243.517 |
| 3,487,823 | 1/1970 | Tarter et al. . | |
| 3,669,408 | 6/1972 | Baxter, Jr. . | |
| 4,763,876 | 8/1988 | Oda et al. . | |
| 4,831,976 | 5/1989 | Pozniak et al. . | |
| 5,537,850 | 7/1996 | Inatani | 72/71 |

FOREIGN PATENT DOCUMENTS

| | | |
|---|---|---|
| 3937402 | 5/1991 | Germany . |

*Primary Examiner*—Robert C. Watson
*Attorney, Agent, or Firm*—Michael, Best & Friedrich

[57] ABSTRACT

A valve seat retainer is formed having a flange that extends over the valve seat and that applies both a radial and a longitudinal force to the valve seat. The flange extends an order of magnitude further than typical prior art valve seat retaining flanges. The flange is created by a rolling method with a roller having a unique surface profile. The roller surface has a pair of spaced ridges with a groove in between, and a curved convex surface adjacent to one of the ridges. When a downward force is applied to the roller, the curved surface on the roller causes the roller to move radially inward while at the same time material from the upper surface of the engine block is disposed in the groove and is moved to create the flange.

10 Claims, 3 Drawing Sheets

FIG. 3
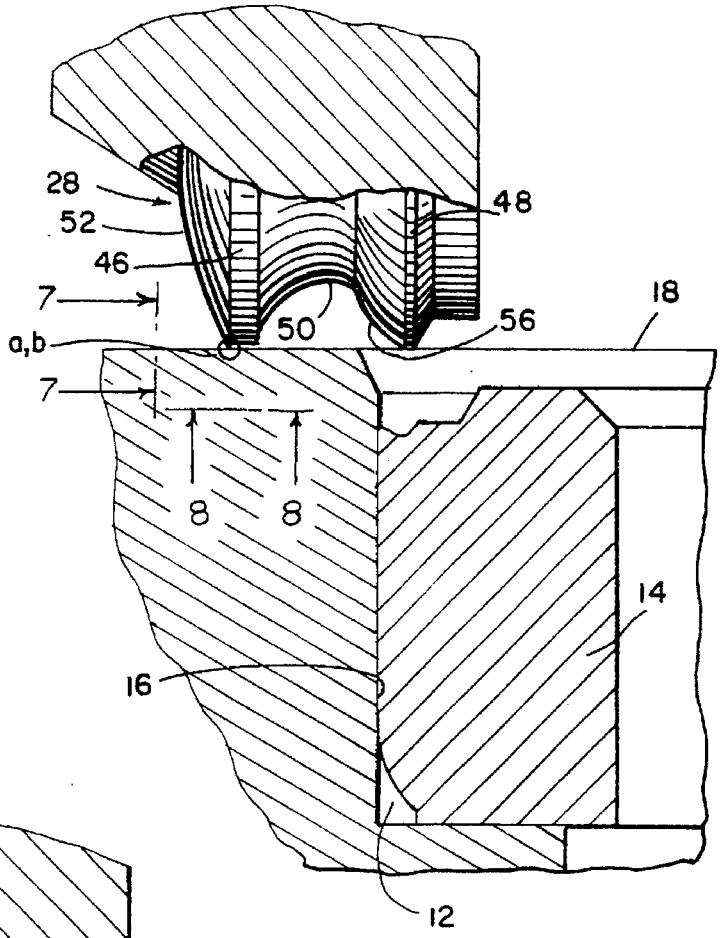
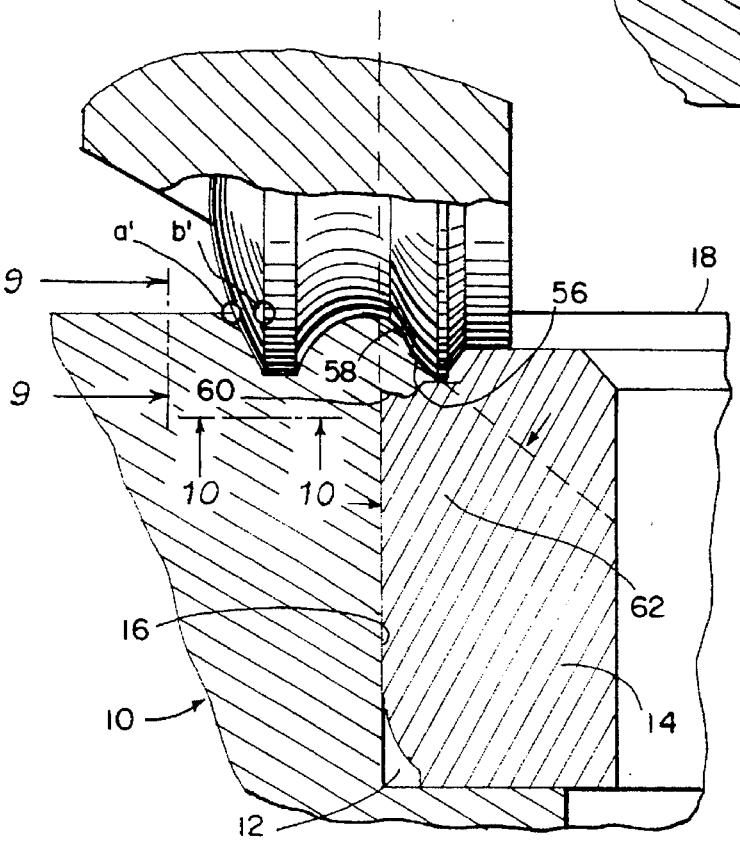
FIG. 4

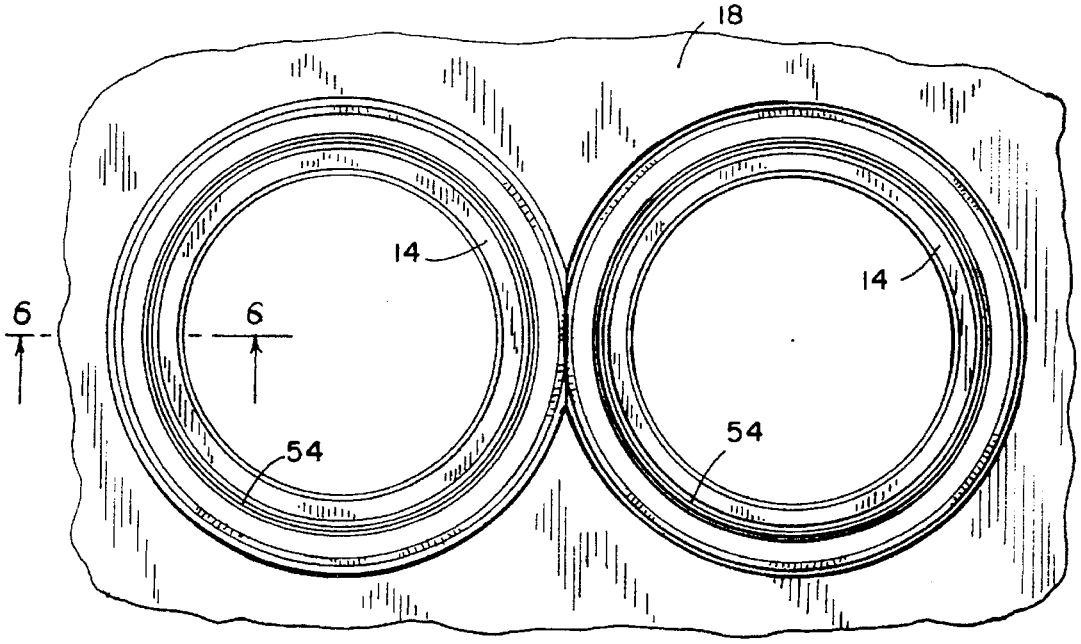
FIG. 5
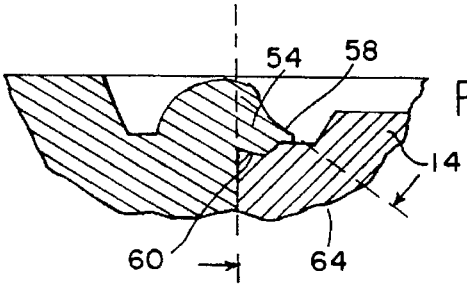
FIG. 6
FIG. 7
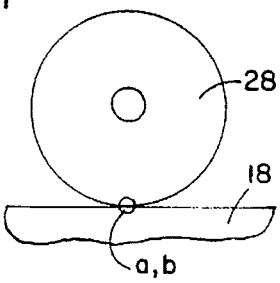
FIG. 9
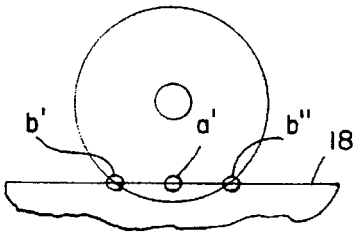
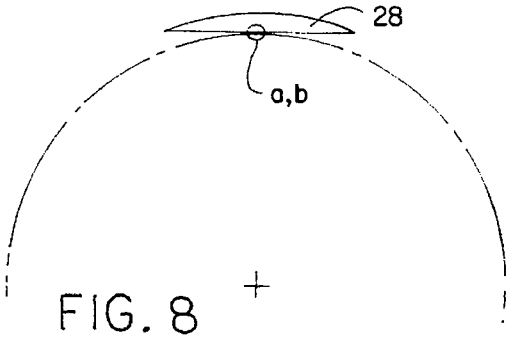
FIG. 8
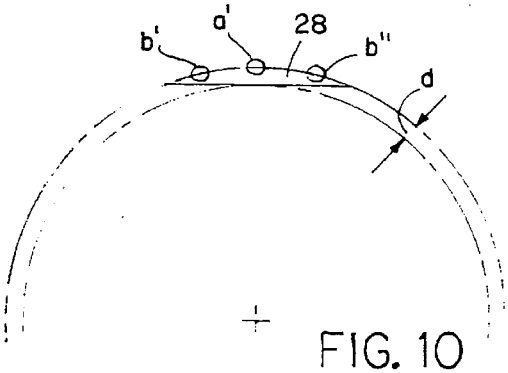
FIG. 10

ROLLING TOOL FOR FORMING A VALVE SEAT RETAINER

This application is a divisional of Ser. No. 08/443,378 filed May 17, 1995 now U.S. Pat. No. 5,522,353.

BACKGROUND OF THE INVENTION

This invention relates to retainers that keep an engine valve seat in a substantially fixed position. More particularly, this invention relates to such retainers manufactured using a rolling apparatus and method.

Valve seats are used in internal combustion engines to seat the intake and exhaust valves. The valve seats are typically distinct components from the engine block, but are interconnected with the block during the engine manufacturing process.

It is essential that the valve seat remains in a substantially fixed position during engine operation. If the valve seat is loosened or displaced altogether, the engine will not operate properly and may fail.

Several methods are known to retain a valve seat in a substantially fixed position. In one prior art method, the valve seat is simply press-fit into a recess in the engine block. A disadvantage of this approach is that the aluminum composite material from which the engine block is made expands at a higher rate than the valve seat. At engine operating temperatures, the valve seat may loosen or dislodge altogether when the engine block material expands in a direction away from the valve seat.

Rolling methods have also been used to create retainers for valve seats. U.S. Pat. No. 2,008,002 issued Jul. 16, 1935 to Calkins and U.S. Pat. No. 1,795,433 issued Mar. 10, 1931 to Leipert both disclose the manufacture of valve seat retainers using a rolling method. U.S. Pat. No. 1,949,614 issued Mar. 6, 1934 to McDonald discloses a preening method. In each of these prior art methods, a small amount of material from the engine block is moved over the valve seat to create an overhang or flange that is intended to retain the valve seat in place. The flange typically extends about 0.003 to 0.005 inches over the valve seat.

Unfortunately, these prior art rolling and preening methods have disadvantages which are similar to the press-fit method discussed above. In these prior art rolling and preening methods, the cylinder block material has a higher thermal rate of expansion than the valve seat, so that the valve seat may loosen at engine operating temperature. The loosened valve seat moves back and forth in its recess, repeatedly striking the overhanging flange. Since the flange is relatively short in length when made according to these prior art methods, the flange may break off, allowing the valve seat to become totally dislodged.

SUMMARY OF THE INVENTION

A valve seat retainer for an internal combustion engine is formed by a unique rolling method and apparatus while the valve seat is in place. The valve seat retainer includes a recess in the engine block that receives the valve seat, and a flange that extends from the engine block above the recess between about 0.030 to 0.040 inches. The flange has a lower surface that forms an included angle with the recess sidewall which is less than 90°, and preferably between 20 to 30 degrees. This flange profile and the method in which the flange is informed impart a force component on the valve seat having a direction vector that is parallel to the longitudinal axis of the valve seat, and also impart a force component having a direction vector that is substantially normal to the longitudinal axis of the valve seat. That is, both a longitudinal force and a radial force are applied to the valve seat to retain the seat in a fixed position. The upper surface of the flange also forms an included angle with the recess sidewall that is less than 90°, and preferably between 40° to 50°.

A unique apparatus and method are used to form a valve seat retainer accordingly to the present invention. The method includes placing a valve seat in a block recess, applying a roller to a surface of the block, rotating the roller and changing the relative position between the roller and the block in an orbital manner to move material from the block surface, moving the roller in a radial direction toward the valve seat longitudinal axis during the roller rotating step, and creating a flange using the moved material, wherein the flange extends over the valve seat. The roller is then raised from the block and returned to a start position by a compression spring connected to the roller.

The apparatus used to form the retainer of the present invention includes a first rotatable shaft, a second rotatable shaft that is non-parallel to and interconnected with the first rotatable shaft, at least one roller interconnected with the second shaft, a means for rotating the first rotable shaft, and a means for rotating the second rotatable shaft.

The roller has a unique working surface shape that is used to achieve the extended flange of the valve retainer. The roller has a first annular ridge, a second annular ridge spaced from the first ridge, a groove disposed between the first and second ridges, and preferably a convex or curved surface adjacent to the first ridge. The apparatus also includes a compression spring that applies a force to the roller in a direction radially outward from the longitudinal axis of the valve seat.

The roller is moved radially inward toward the seat's longitudinal axis by applying a downward force on the roller to the curved roller surface. At the same time, material from the engine block surface is disposed in a groove between the two ridges on the roller and is moved over the edge of the recess to create the flange.

It is a feature of and advantage of the present invention to provide a valve seat retainer that applies both a radial and a longitudinal force onto the valve seat.

It is another feature and advantage of the present invention to create a valve seat retaining flange that is an order of magnitude longer than prior art flanges.

It is yet another feature and advantage of the present invention to provide a valve seat retainer that minimizes the likelihood that the valve seat will loosen or dislodge at engine operating temperatures.

These and other features and advantages of the present invention will be apparent to those skilled in the art from the following description of the preferred embodiment and the drawings, in which:

BRIEF DESCRIPTION OF THE DRAWINGS

FIG. 3 is a side view, shown in partial section, of a roller contacting the engine block at the start of the rolling process, taken along line 3—3 of FIG. 1.

FIG. 4 is a side view, shown in partial section, of the roller after it has moved into the engine block surface.

FIG. 5 is a top view of intake and exhaust valve seats after the respective retainers have been manufactured.

FIG. 6 is a side cross sectional view of a valve seat retainer according to the present invention engaging a valve seat.

FIGS. 7 and 8 are schematic diagrams corresponding to the start position depicted in FIG. 3. FIG. 7 is a schematic diagram corresponding to the view along line 7—7 of FIG. 3. FIG. 8 is a schematic diagram corresponding to the view along line 8—8 of FIG. 3.

FIGS. 9 and 10 are schematic diagrams depicting the position of the roller of FIG. 4. FIG. 9 is a schematic diagram of a side view of the roller and engine block corresponding to the view along line 9—9 of FIG. 4. FIG. 10 is a schematic diagram of the roller and engine block of FIG. 4 corresponding to the view along line 10—10 of FIG. 4.

DETAILED DESCRIPTION OF THE PREFERRED EMBODIMENT

Figure 1:
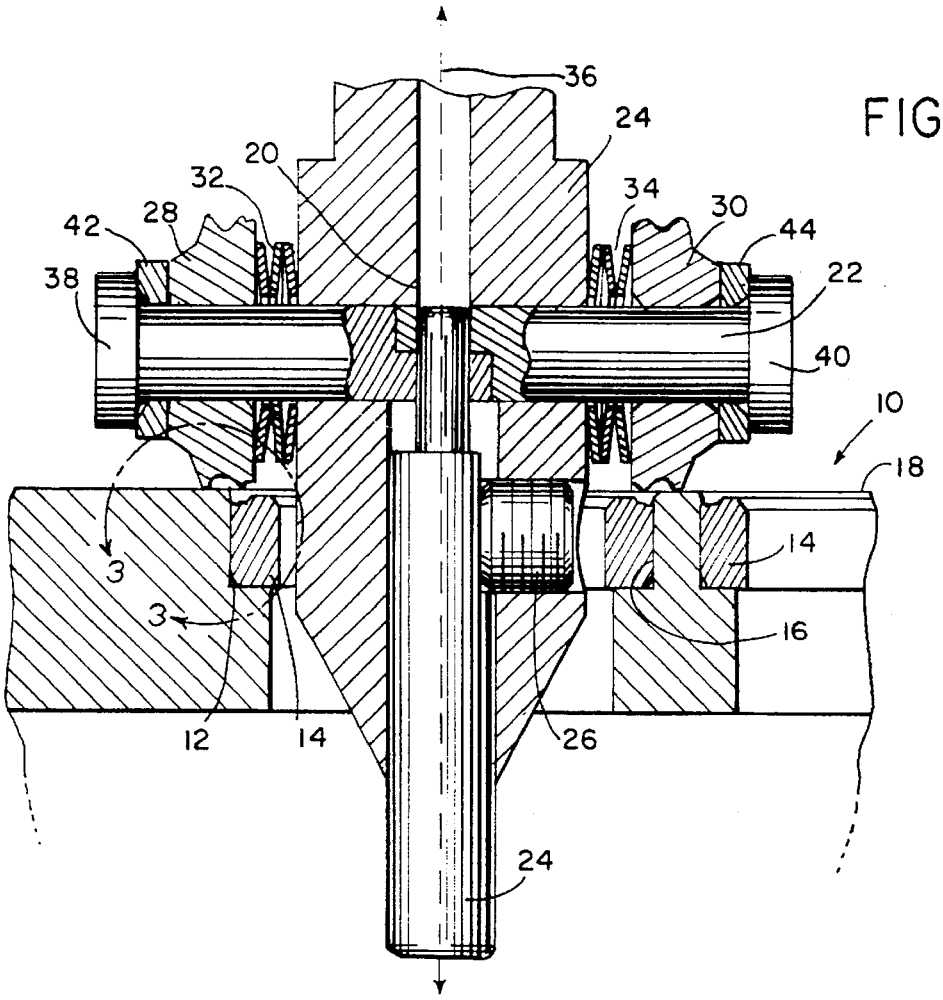
FIG. 1 is a side view, showing in partial section, of the apparatus for manufacturing a valve seat retainer according to the present invention, taken along line 1—1 of FIG. 2.

FIG. 1 depicts the apparatus used to manufacture a valve seat retainer according to the present invention. In FIG. 1, an engine block 10 of an internal combustion engine has a recess 12 that receives a valve seat insert 14. Recess 12 has a sidewall 16 that engages valve seat 14. Valve seat 14 is placed in recess 12 before the manufacturing process begins.

Engine block 10 has an upper surface 18 which typically corresponds to the upper surface of the engine cylinder head. Engine block 10 and upper surface 18 are typically made from an aluminum alloy which is well known in the art. Some of this aluminum material is moved from initially flat upper surface 18 to create the flange of the present valve seat retainer.

The aluminum alloy material is moved using the rolling apparatus depicted in FIG. 1. In FIG. 1, the rolling apparatus includes a first rotatable shaft 20, a second rotatable shaft 22 that is disposed at a non-parallel angle to shaft 20, and a tool holder assembly 24. Tool holder assembly 24 may be part of a standard drill press, as discussed below. Shaft 22 is preferably normal to shaft 20, although other non-parallel angles may be used. The relative position of shaft 22 with respect to upper surface 18 may be changed using a threaded lug 26.

A drive means (not shown) is used to rotate shaft 20, while at the same time rotating shaft 22, as is well known in the art. One suitable drive means is a standard drill press made by EVCO Bench and Floor Drill Press, Chicago, Ill., Model No. 202-2170.

Rotation of shaft 22 results in a rotation of two opposed rollers 28 and 30 which are interconnected with shaft 22. Although two rollers are depicted and described in connection with the preferred embodiment herein, it will be apparent to those skilled in the art that a single roller could be used. Rollers 28 and 30 are the tools used to move the material to create the valve seat retaining flange.

As depicted in FIG. 1, a compression spring 32 engages roller 28, and a compression spring 34 engages roller 30. The purpose of springs 32 and 34 is to apply a force on their respective rollers 28 and 30 in a radially outward direction from axis 36. Axis 36 is the longitudinal axis of valve seat 14, and, in the embodiment of FIG. 1, also coincides with the axis of shaft 20. Springs 32 and 34 oppose the radially-inward movement of rollers 28 and 30 respectively during the retainer manufacturing process. As discussed below, rollers 28 and 30 move radially inward toward longitudinal axis 36 during the manufacturing process as a result of the surface profiles of rollers 28 and 30. Springs 32 and 34 also move their respective rollers 28 and 30 in a radially outward direction from axis 36 after the retainer has been manufactured and rollers 28 and 30 have been lifted from block surface 18. That is, springs 32 and 34 return rollers 28 and 30 respectively to their starting positions. Springs 32 and 34 are preferably comprised of Belleville washers, although other types of springs may be used.

Rollers 28 and 30 are retained by respective shoulders 38 and 40 affixed to shaft 22, and by respective bushings 42 and 44 disposed between their respective rollers 28 and 30 and respective shoulders 38 and 40.

Figure 2:
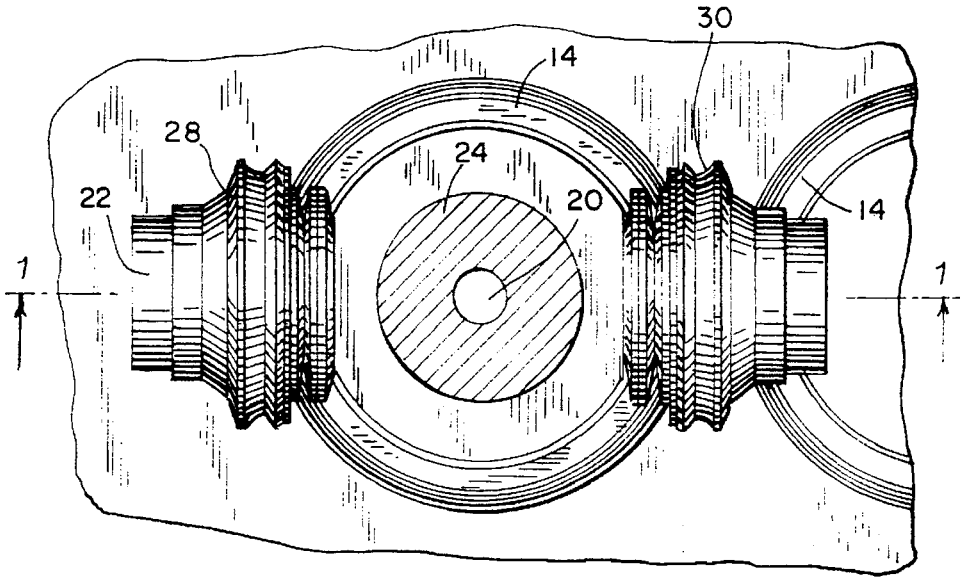
FIG. 2 is a top view of the apparatus of FIG. 1.

FIG. 2 is a top view of the apparatus of FIG. 1, and more clearly depicts the orientation of the rolling apparatus with respect to valve seat 14.

An important feature of the present invention is the surface profile of rollers 28 and 30, since this profile is used to create the retainer according to the present invention. Since rollers 28 and 30 are the same, only one of the rollers will be discussed herein.

The surface profile of roller 20 is depicted in FIGS. 1 through 4, but is best shown in FIGS. 3 and 4. In FIGS. 3 and 4, roller 28 has a first ridge 46, a second ridge 48 spaced from ridge 46, and a groove 50 disposed between first ridge 46 and second ridge 48. Adjacent to first ridge 46 is a curved surface 52 that is preferably convex or spherical in shape. The shape of surface 52 is selected to avoid splintering of block surface 18 while roller 28 is being rotated and orbited to create a valve retainer. The shapes of surface 52 and ridge 46 are also a function of the amount of material from surface 18 that is to be moved to create retaining flange 54 (FIG. 4). The shape of groove 50 is also a function of the amount of material that is to be rolled to create flange 54. Curved surface 56, adjacent to ridge 48, is also a convex or spherical surface whose profile is in part determined by the desired profile of upper surface 58 of flange 54, as well as by the desired profile of lower surface 60 of flange 54. As shown in FIG. 4, surface, 58 is used to form surface 56.

The shape of surface 52 is primarily necessitated by the requirement that roller 28 move radially inward toward longitudinal axis 36 of the valve seat during the retainer manufacturing process. Roller 28 must move radially inward to keep roller 28 from actually cutting into engine block surface 18, as opposed to moving material from surface 18 to another location. This cutting is prevented by providing curved surface 52. As roller 28 rotates and is moved downward toward block surface 18 to engage surface 18, surface 52 contacts engine block 10, thereby moving roller 28 radially inward in opposition to the spring force of spring 32.

The interrelationship between the profile of roller 28 and the engine block is best understood by reference to FIGS. 3 and 4, and FIGS. 7 through 10. FIGS. 3 and 7 are side views of the roller at the start position. In FIGS. 3 and 7, curved surface 52 contacts block surface 18 at a point a. Also, ridge 46 contacts block surface 18 at a point b. These points a and b are also depicted in the top view, of FIG. 8. Contact points a and b coincide with each other at the start position.

However, the point at which curved surface 52 contacts block surface 18 no longer coincides the point at which ridge 46 contacts block surface 18 once roller 28 moves in a direction parallel to longitudinal axis 36 (FIG. 1) into engine block 10. At this stage, curved surface 52 contacts block surface 18 at a point a', which is distinct from point a in FIGS. 3 and 7 through 8. After the start position, ridge 46 contacts block surface 18 at a pair of points b' and b", instead of at a single point b at the start position (FIGS. 3 and 7 through 8). Contact points b' and b" are depicted in FIGS. 9 and 10.

If surface 52 was not a curved surface, roller 28 would not move radially inward while it was being rotated and orbited by the drill press during the manufacturing process. This would result in cutting upper surface 18 in a series of straight lines, analogous to the way in which a pizza cutter would cut a pizza if an attempt was made to cut a circular piece. Such straight line cutting would result in undesirable splintering of the engine block material. However, curved surface 52 also contacts block surface 18 during the rolling process, forcing roller 28 radially inward to prevent cuts from being made along straight lines. The distance by which roller 28 is moved radially inward corresponds to distance d in FIG. 10.

A method used to manufacture the valve seat retainer according to the present invention will now be described in connection with FIGS. 1 through 6.

The first step is to insert valve seat 14 into recess 12. Thereafter, the rolling apparatus (drill press) is placed in the start position as depicted in FIG. 1. As depicted in FIGS. 1 and 3, rollers 28 and 30 contact upper surface 18 in the start position.

Thereafter, a force is applied to rollers 28 and 30 so that the rollers are moved downward by the drill press in a direction parallel to longitudinal axis 36, such that the respective roller working surfaces engage block 10. At the same time, shaft 22 is rotated by the drill press to spin the rollers while shaft 20 is rotated by the drill press to orbit the rollers in an orbital manner about the substantially fixed engine block. In the alternative, shaft 20 may remain stationary and the engine block may rotate.

As rollers 28 and 30 move into block surface 18 and engine block 10, rollers 28 and 30 move radially inward toward longitudinal axis 36 as a result of their respective curved surfaces. Consequently, material from engine block 10 is moved into groove 50 and above recess 12 to create retaining flange 54.

As depicted in FIGS. 4 and 6, retaining flange 54 has an upper surface 58 that forms an included angle 62 with sidewall 16 which is less than 90°, and preferably between 40° to 50°. Similarly, flange 54 has a lower surface 60 that forms an included angle 64 with sidewall 16 that is less than 90°, and preferably between 20° to 30°.

Flange 54 extends between about 0.030 to 0.040 inches from engine block 10 above recess 12.

The configuration and method of forming flange 54 cause flange 54 to impart a force on valve seat 14 having a force component direction vector that is parallel to longitudinal axis 36 (i.e., in the axial direction) as well as a force component having a direction vector that is perpendicular to longitudinal axis 36 (i.e., in the radial direction). These force vectors cause valve seat 14 to be positively retained within recess 12, to prevent valve seat 14 from loosening or dislodging during engine operation.

A completed assembly depicting both the valve seats for an engine intake valve and an engine exhaust valve is shown in FIG. 5.

Although the preferred embodiment has been shown and described, alternate embodiments will be apparent to those skilled in the art and are within the intended scope of the present invention. Therefore, the invention is to be limited only by the following claims.

I claim:

1. Apparatus for forming a retainer for an engine valve seat in an engine block, said apparatus comprising:

a first rotatable shaft that rotates about a longitudinal axis;

a second rotatable shaft, non-parallel to and interconnected with said first rotatable shaft;

a roller interconnected with said second shaft, said roller having a working surface that includes a first ridge that engages said block;

a curved surface that engages said block, disposed adjacent to said first ridge and radially outward of said first ridge with respect to said longitudinal axis;

a second ridge spaced from said first ridge and disposed radially inward from said first ridge with respect to said longitudinal axis; and a groove disposed between said first ridge and said second ridge.

2. The apparatus of claim 1, wherein said curved surface is convex.

3. The apparatus of claim 1, wherein said curved surface is spherical.

4. The apparatus of claim 1, further comprising:

a second curved surface disposed adjacent to said second ridge and radially outward from said second ridge with respect to said longitudinal axis.

5. The apparatus of claim 4, wherein said second surface is convex.

6. The apparatus of claim 4, wherein said second surface is spherical.

7. The apparatus of claim 1, further comprising:

means for moving said roller in a radial direction toward said longitudinal axis.

8. The apparatus of claim 6, wherein said moving means includes:

means for applying a force to said roller that is substantially parallel to said longitudinal axis.

9. The apparatus of claim 7, further comprising:

second means for moving said roller in a radial direction away from said longitudinal axis.

10. The apparatus of claim 9, wherein said second means includes:

a compression spring that engages said roller.

* * * * *